United States Patent [19]

Utter

[11] 4,054,083

[45] Oct. 18, 1977

[54] DUAL LEVER CONTROL MECHANISM

[75] Inventor: Robert Eugene Utter, LaCrosse, Wis.

[73] Assignee: Caterpillar Tractor Co., Peoria, Ill.

[21] Appl. No.: 595,820

[22] Filed: July 14, 1975

[51] Int. Cl.[2] ..... F15B 11/16

[52] U.S. Cl. ..... 91/413; 74/471 R; 74/479; 91/414; 91/459; 137/596.17; 137/637

[58] Field of Search ..... 91/413, 414, 459; 74/479, 471 R; 137/637, 596.17

[56] References Cited

U.S. PATENT DOCUMENTS

| | | | |
|---|---|---|---|
| 3,306,392 | 2/1967 | Kilmer | 91/413 |
| 3,488,955 | 1/1970 | Buelow | 60/492 |
| 3,540,220 | 11/1970 | Lauck | 91/413 |
| 3,611,827 | 10/1971 | Bottum | 91/413 |
| 3,705,631 | 12/1972 | Seaberg | 91/413 |
| 3,774,696 | 11/1973 | Horsch | 91/412 |
| 3,783,962 | 1/1974 | Shaffer | 74/479 |
| 3,795,280 | 3/1974 | Casey | 91/413 |
| 3,837,417 | 9/1974 | Little | 180/6.48 |
| 3,853,193 | 12/1974 | Dunn | 180/6.48 |

FOREIGN PATENT DOCUMENTS

| | | | |
|---|---|---|---|
| 2,448,816 | 4/1975 | Germany | 214/138 D |

*Primary Examiner*—Martin P. Schwadron
*Assistant Examiner*—Abraham Hershkovitz
*Attorney, Agent, or Firm*—Charles E. Lanchantin, Jr,

[57] ABSTRACT

A dual lever control mechanism is disclosed for actuating a pair of control devices individually having first and second modes of operation, including a stationary support, a first lever arrangement pivotally mounted on the support for selectively moving both of the control devices into either their first modes of operation or their second modes of operation for effecting simultaneous coordinated movement thereof, and a second lever arrangement pivotally mounted on the support and cooperatively coupled with a portion of the first lever arrangement for selectively moving both of the control devices respectively into either their first and second modes of operation or their second and first modes of operation for effecting simultaneously opposite coordinated movement thereof.

7 Claims, 4 Drawing Figures

NEUTRAL
SECOND POSITION
FIRST POSITION
SECOND POSITION
NEUTRAL
FIRST POSITION
10
18
16
46
70
72
50
48
56
70
84
78
110
80
30
54
64
94
76
112
60
98
66
82
62
92
72
68
116
106
90
108
12
20
22
FIRST CONTROL VALVE
28
26
24
32
FLUID SOURCE
40
38
14
SECOND CONTROL VALVE
S
S
42
44
34
36

DUAL LEVER CONTROL MECHANISM

BACKGROUND OF THE INVENTION

There are many and diverse types of apparatus which function to move an object in various directions. Among these apparatus are included power operated implements such as buckets, booms and bulldozer blades which are usually mounted on a vehicle and manipulated by a plurality of individual controls. The operator must give a great deal of attention to selectively moving the various levers, buttons, or the like into their proper modes of operation in order to correspondingly maneuver the various hydraulic motors or jacks which control the complex movement of the implement.

For example, while two separate levers can be utilized for individually operating a pair of valves in a hydraulic system and thereby directing fluid selectively to the opposite ends of a pair of hydraulic jacks, there is frequently the need to simultaneously move the jacks in the same direction or in opposite directions at the same rate. This is difficult to accomplish when the operator is also maneuvering the vehicle or manipulating a separate control element since two hands are usually required. On the other hand, if an attempt is made to mechanically connect each of the levers with both of the control valves so that the two jacks can be simultaneously extended or retracted with one lever or can be simultaneously moved in opposite directions with the other, then movement of one lever would disadvantageously move the other. In addition, it is usually desirable that both control levers be automatically returned to a neutral or jack-holding position upon manually releasing them, and yet when operating an individual lever the effort which is required should be minimal. It is thus apparent that a complex coupling problem is involved when connecting both levers to both valves.

While it would appear to be desirable to utilize a single control lever to position a pair of hydraulic jacks through a suitable control valve arrangement, it is not always easy to relate the required hand movement with the desired implement movement. Furthermore, operator movement of a universally pivotable single control lever can easily lead to unequal rates of movement of the jacks to the point of requiring correctional manipulation of the lever at a crucial operating time.

Reference is herein made to U.S. Pat. No. 3,705,631 issued Dec. 12, 1972 to D. H. Seaberg, and U.S. Pat. No. 3,795,280 issued Mar. 5, 1974, the latter of which is assigned to the assignee of the present invention, which relate to control arrangements and associated hydraulic control circuits for selectively actuating separate hydraulic jacks for lifting, tilting and angling a bulldozer blade on a tractor. While such controls have been well received by the industry, it takes a special degree of dexterity and alertness to operate them. Particularly, it is difficult to correctly manipulate an electrical switch disposed on or adjacent to the single control lever. As a result, the operator will occasionally move the switch in the wrong direction or hold it engaged an excessively long period. As a consequence, one of the hydraulic jacks might well be at the end of its stroke so that the additional fluid flow being directed thereto by the inadvertent engagement of the switch must be exhausted at the relatively high pressure setting of the system relief valve. As is well known in the art, any prolonged exhausting of fluid against the system relief valve pressure is undesirable from many standpoints.

Another problem is that these lever control arrangements cannot always be disposed immediately adjacent to the control valves. As a result they must cooperate with various hydraulic or electrical piloting devices to remotely actuate the control valves and to thereby affect operating economies for certain member placement advantages on the vehicle.

SUMMARY AND OBJECTS OF THE INVENTION

Accordingly, an object of this invention is to overcome the above briefly described problems by providing a conveniently operable dual lever control mechanism which can positively position a pair of control devices for simultaneous coordinated movement or for simultaneously opposite coordinated movement with but minimal operator care. Such a control mechanism is particularly adapted for manipulating a pair of hydraulic jacks for tilting or tipping a bulldozer blade relative to the vehicle on which it is mounted.

Another object of the present invention is to provide such a dual lever control mechanism which will prevent the manual positioning of one of the control levers from moving the other one.

Another object is to provide a dual lever control mechanism of the character described which will automatically bias the control levers thereof to a neutral position in the absence of any manual effort thereon, and while contributing only minimal operating effort to overcome this biasing load.

Other objects and advantages of the present invention will become more readily apparent upon reference to the accompanying drawings and following description.

DESCRIPTION OF PREFERRED EMBODIMENT

Figure 1:
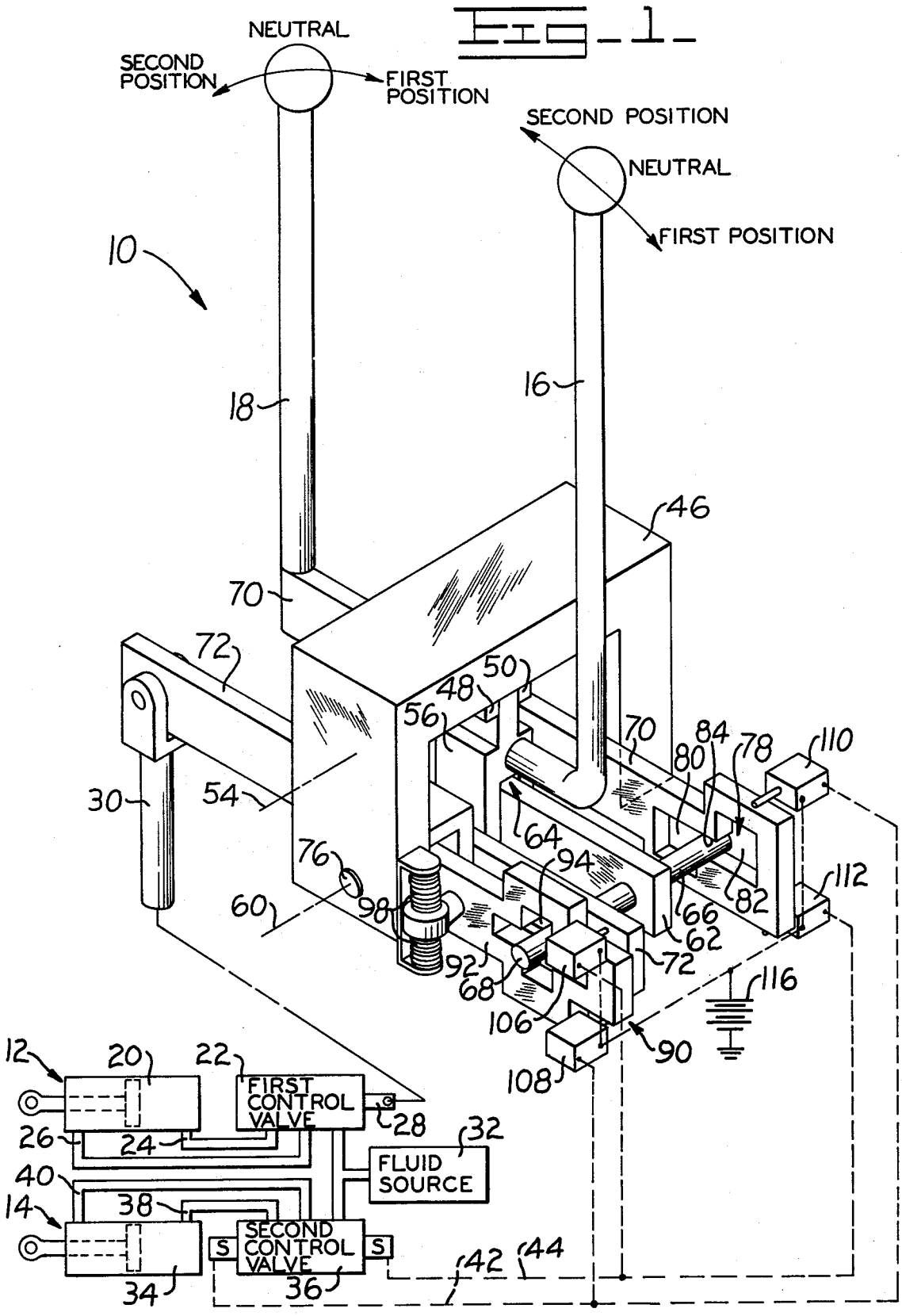
FIG. 1 is a perspective view of the dual lever control mechanism of the present invention with the elements thereof disposed in a neutral mode of operation, and shown in operative combination with a pair of schematically illustrated control devices.

Referring initially to FIG. 1 of the drawings, a dual lever control mechanism 10 is shown which effectively permits simultaneous coordinated actuation of a pair of control devices 12 and 14, or alternately simultaneously opposite coordinated actuation thereof. This is, in general respectively achieved by manually moving a first control lever 16 or a second control lever 18 away from their respective central neutral or holding positions.

The first control device 12 includes a first reversible motor or hydraulic jack 20 which receives fluid from, and returns fluid to a first control valve 22 via a pair of hydraulic conduits 24 and 26. A spool member 28 is manually axially positioned by a control rod 30 associated with the dual lever control mechanism 10 through suitable interconnecting linkage of the usual type, not shown, into first or second modes of operation on either side of a central jack holding condition. Such movement of the spool member permits fluid from a pressurized supply source 32 to be selectively communicated to the first jack through the conduit 24 or the conduit 26 to respectively extend or retract it.

In a similar manner, the second control device 14 includes a second reversible motor or hydraulic jack 34 which is in fluid communication with a solenoid actuated second control valve 36 through a pair of hydraulic conduits 38 and 40. An internal spool member, not shown, is disposed for reciprocal movement within the second control valve in response to electrical signals to its solenoids in either of a pair of signal lines 42 and 44. As will hereinafter be described, such signals are triggered by movement of certain portions of a dual lever control mechanism 10. Consequently, with a signal present in either of these lines, the internal spool member is axially moved away from a central jack holding position and into first or second modes of operation, to allow fluid from the supply source 32 to be selectively communicated to the second jack through the conduits 38 or 40 to respectively extend or retract it.

Therefore, it is to be generally appreciated that the hydraulic jacks 20 and 34 may be simultaneously actuated for coordinated extending or retracting movement through manual placement of the first lever 16 respectively into a first position or a second position as illustrated in FIG. 1, or alternately may be actuated for simultaneously opposite coordinated movement through placement of the second lever 18 into its first or second positions. Such action, for example, is particularly desirable for controlling the hydraulic jacks associated with tipping and tilting of a bulldozer blade as is specifically disclosed in copending U.S. Pat. No. 3,997,007, issued Dec. 14, 1976 to J. A. Junck, et al, and assigned to the assignee of the present invention, or as more generally disclosed in U.S. Pat. No. 3,774,696, issued Nov. 27, 1973 to R. Horsch. Simultaneous movement of both jacks in the same direction, in both the referenced cases, would result in tipping of the bulldozer blade about a horizontal axis parallel to the blade, while simulataneous opposite movement of the jacks would result in tilting the blade about a horizontal axis perpendicular to the blade.

Figure 2:
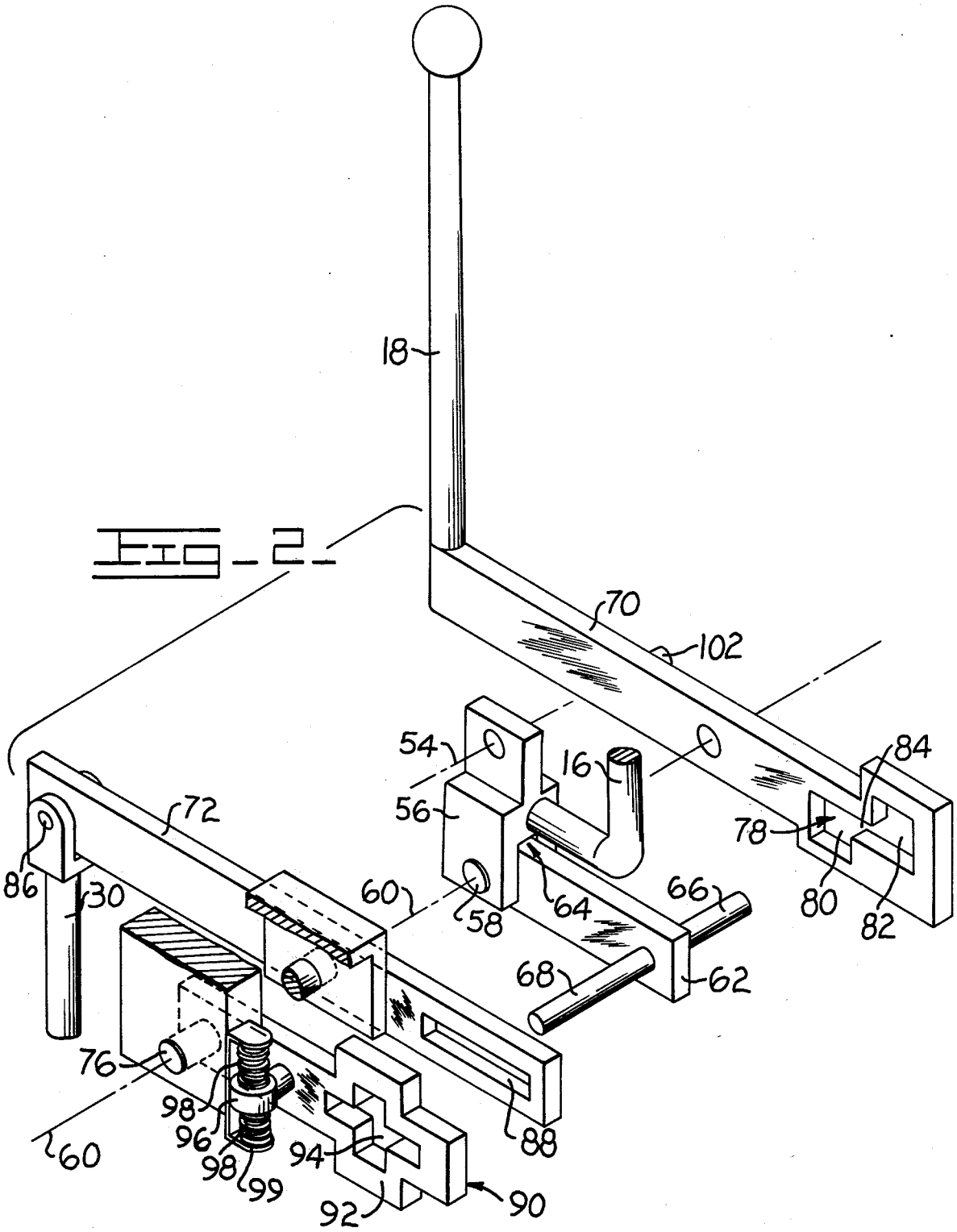
FIG. 2 is a fragmentary exploded view of the principle elements of the dual lever control mechanism of FIG. 1, better illustrating certain features thereof.
Figure 3:
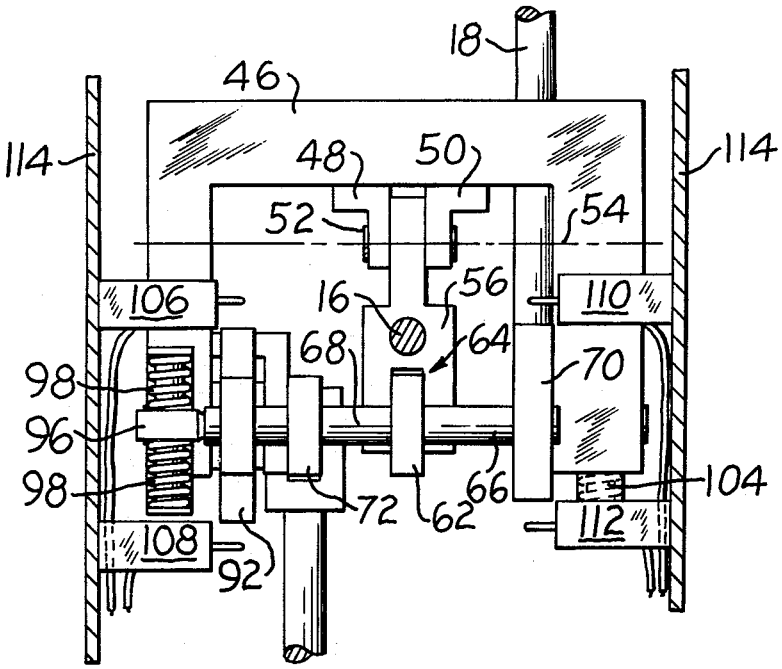
FIG. 3 is a fragmentary end elevational view of the dual lever control mechanism of FIG. 1, only representively showing a pair of stationary side plates on which four operatively associated electrical switches are mounted.

More particularly, the dual lever control mechanism 10 of the present invention includes a stationary, inverted U-shaped support structure 46 having a pair of laterally separated, outwardly facing angle members 48 and 50 secured in a depending manner within it as shown best in FIG. 3. A pivot pin 52 is secured to the angle members and is transversely arranged along an upper axis 54 for rotatably supporting a depending yoke 56 to which is integrally secured the first control lever 16. As clearly illustrated in FIG. 2, the yoke has a pivot pin 58 transversely arranged along a lower axis 60 when in its central position, and an intermediate actuating element 62 is limitedly pivotally journalled thereon.

In accordance with one aspect of the invention, a predetermined vertical clearance is provided intermediate the upper surface of the actuating element 62 and the root of the yoke 56 is indicated generally by the reference numeral 64. Consequently, upon experiencing a predetermined angular movement between them away from their central positions shown, the actuating element will abut the yoke root and thereafter be effectively coupled for rotary movement with the yoke. Further, a pair of laterally aligned arms 66 and 68 are secured near the end of the actuating element for purposes which will subsequently be explained.

Figure 4:
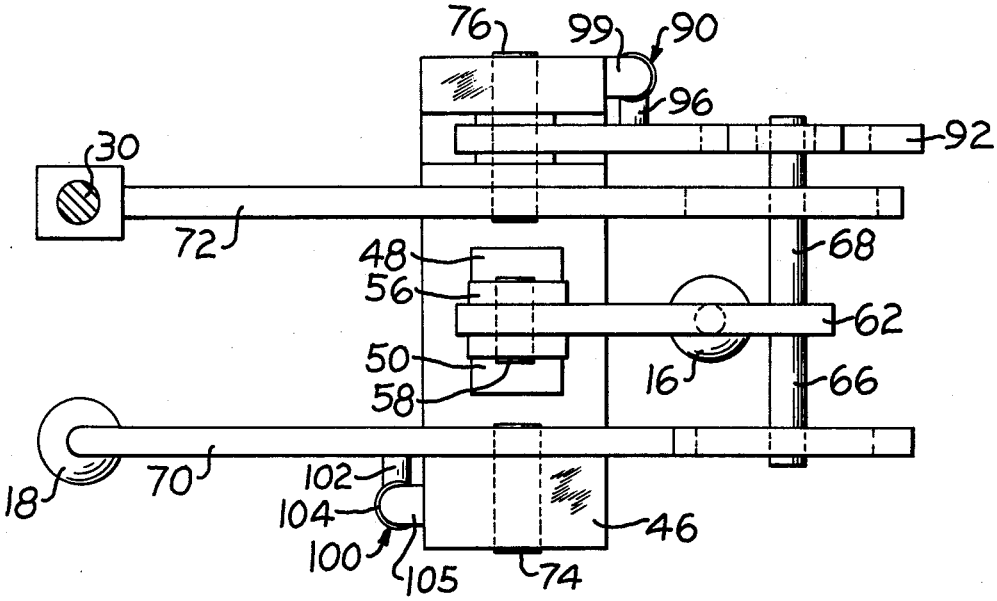
FIG. 4 is a bottom view of the dual lever control mechanism of FIG. 1, with the operationally associated electrical switch portion thereof deleted for illustrative clarity.

As more clearly illustrated in FIGS. 2 and 4, the dual lever control mechanism 10 also includes an input beam 70 and an output beam 72 rockably mounted within the support structure 46 respectively on a pair of pivot pins 74 and 76 arranged on the lower axis 60. The second control lever 18 is integrally secured to one extremity of the input beam, while the other end is provided with a profiled aperture identified generally by the reference numeral 78 therein which is adapted to receive the arm 66. This aperture may be considered as being formed by a radially inner pocket 80, a radially outer pocket 82 elevationally offset therefrom, and a smaller pocket 84 blendably associated centrally therebetween which relatively closely embraces the arm in the neutral position of the first control lever 16. On the other hand, the output beam 72 is secured at one extremity through a pivot pin 86 to the yoked end of the control rod 30, and at the other end is adapted to receive the extended arm 68 of the intermediate actuating element 62 through an elongated slot 88.

As shown in FIG. 2, combined resilient centering and switch actuating apparatus generally indicated by the reference numeral 90 is operatively associated with the output beam 72 through the extended arm 68. Such apparatus includes a lever 92 pivotally mounted on the pin 76, a cross-shaped aperture 94 formed in the lever to receive the extended arm, and a cantilevered member 96 adapted to be biasably contacted by a pair of opposing compression springs 98 mounted on the support structure 46 through a holder 99.

As partially shown in FIG. 4, a somewhat simpler resilient centering apparatus 100 is associated with the input beam 70. A cantilevered member 102 extends integrally from the input beam and is also adapted to be centrally biased by a pair of compression springs 104 mounted in a corresponding holder 105 on the support structure 46.

Referring now to FIG. 1, it is to be noted that the lever 92 which is operatively associated with the output beam 72 through the extended arm 68 is also responsible for directionally actuating either of a pair of electrical switches 106 and 108 upon arcuate movement thereof from its central positions shown. In a like manner the profiled extremity of the input beam is responsible for directionally actuating or triggering either of a pair of similar electrical switches 110 and 112. These switches are mounted to a pair of stationary side plates 114, as representatively shown in FIG. 3, and are connected to an electrical power source 116. In a beneficial manner they are cross-connected so that the switches 106 and 112 or 108 and 110 are respectively associated with the signal lines 44 and 42 for causing the second control valve 36 to be actuated into its jack retracting or jack extending mode of operation.

OPERATION

While the operation of the present invention is beleived clearly apparent from the foregoing description, further amplification will subsequently be made in the following brief summary of such operation. As is clearly apparent when viewing FIG. 1, the initial movement of the first control lever 16 in a clockwise manner correspondingly rotates the yoke 65 about the upper axis 54 and causes leftward movement of the intermediate actuating element 62. Accordingly, the arm 66 of the actuating element is moved leftwardly away from the position shown within the input beam aperture 78 and into the radially inner pocket 80 thereof, while oppositely simultaneously couplingly engaging the extended arm 68 with the radially inner horizontal slot of the cross-shaped aperture 94 formed in the centering lever 9. As may be best visualized by reference to FIG. 2, the initial leftward and substantially horizontal movement of the actuating element does not cause any corresponding movement of the output beam 72 because of the lost motion action of the extended arm within the elongated slot 88.

Upon further movement of the first control lever 16 fully into its first position as indicated by the legend in FIG. 1, the predetermined clearance indicated at 64 intermediate the yoke 56 and the actuating element 62 is taken up, and subsequently the yoke and the actuating element rotate as a unit around the upper axis 54. Under these circumstances the extended arm 68 moves arcuately downwardly and, in general, rotates the output beam 72 in a clockwise manner to move the control rod 30 upwardly when viewing the drawing. This is sufficient to move the spool member 28 of the first control valve 22 so that pressure fluid is directed to the first hydraulic jack 20 via the conduit 24 to extend it. At the same time, the extended arm 68 couplingly causes the centering lever 92 to move in a clockwise manner to trigger engagement of the lower electrical switch 108. Actuation of this switch permits an electrical signal to be directed to the signal line 42 and to the second control valve 36 to permit fluid flow through the conduit 38 to the head end of the second hydraulic jack 34. In this way movement of the first lever to first position causes simultaneous extension of both the hydraulic jacks. However, because the other arm 66 is disposed with a significant degree of clearance in the enlarged pocket 80, the rotational movement thereof is not transmitted back to the input beam so that the second control lever 18 is not moved.

In a similar manner, the initial movement of the first control lever 16 toward its second position will cause independent movement of the yoke 56 and actuating element 62 to substantially solely horizontally position the arms 66 and 68 respectively into the radially outer pocket 82 and radially outer horizontal slot of the cross-shaped aperture 94. With further arcuate movement of the control lever fully into its second position, the extended arm 68 is moved arcuately in a counterclockwise manner when viewing the drawing to rotate the output beam 72 in the same direction and to lower the control rod 30. This positions the spool member 28 in the opposite direction so that fluid is transmitted from the first control valve 22 via the conduit 26 to the rod end of the first hydraulic jack to retract it. Also, since the lever 92 is rotated in a counterclockwise manner the upper electrical switch 106 is actuated to direct an electrical signal from the source 116 to the opposite signal line 44. This causes the second control valve to direct fluid to the rod end of the second jack 34 via the conduit 40 to simultaneously retract it. This movement also is not transmitted to the second control lever 18 because the arm 66 is disposed within the enlarged radially outer pocket 82.

When it is desired to move the hydraulic jacks 20 and 34 in opposite directions at the same time, the second control lever 18 is manipulated. For example, upon the initial movement of the second control lever toward the first position indicated by the legend in FIG. 1, the input beam 70 is rotated in a clockwise manner about the lower axis 60 to immediately cause actuation of the electrical switch 112, and thus an electrical signal to be directed to the second control valve 36 through the signal line 44. Fluid is subsequently directed by the second control valve to the rod end of the second jack 34 via the conduit 40 to retract it. Since the arm 66 is closely received within the central pocket 84, the opposite arm 68 is caused to immediately rotate about the lower axis and to move the output beam 72 in a clockwise manner to raise the control rod 30. As set forth above, this is sufficient to cause fluid to be directed to the head end of the first hydraulic jack 20 to extend it. It is significant to note that because of the predetermined clearance 64 between the yoke 56 and actuating element 62 the actuating element is free to rotate in a clockwise manner without such motion affecting the central disposition of the yoke and the first control lever 16. Further, the movement of the extended arm 68 is substantially vertical and centrally within the cross-shaped aperture 94 so that the lever 92 is not moved.

Lastly, in a corresponding manner, movement of the second control lever to its second position will cause counterclockwise movement of the input beam 70 and the immediate triggering of the electrical switch 110. This subsequently directs an electrical signal to the signal line 42 for extension of the second hydraulic jack 34. Since the arm 66 of the actuating element 62 is closely received in the input beam, the coextensive opposite arm 68 is immediately moved therewith causing counterclockwise rotation of the output beam 72 and downward movement of the control rod 30. As stated above, this motion retracts the first jack 24. Further, because of the predetermined clearance at 64, the movement of the second control lever is not transmitted to the first control lever 16.

It is to be understood that upon movement of the first control lever 16, it is substantially decoupled from the second control lever 18 through the free arcuate movement of the arm 66 within the aperture 78, and with the resilient centering apparatus 100 illustrated in FIG. 4 holding the second control lever in its neutral position. At the same time, however, the opposite arm 68 is closely engaged in either of the cross slots of the cross-shaped aperture 94 so that one of the springs 98 is compressed. Upon manually releasing the first control lever the compressed spring will bias the lever 92 back to its centered condition and also return the output beam 72, the actuating element 62 and the first control lever to neutral.

Moreover, when the second control lever 18 is actuated, the extended arm 68 is decoupled from the centering apparatus 90 so that any force due to the compression of either of the springs 98 does not have to be overcome by the operator. In such instance only the loading of one of the compression springs 104 is overcome, and upon release of the lever 18 from either of its operating modes the biasably loaded centering apparatus 100 acts to center the input beam 70 and the control lever itself.

In view of the foregoing, it is readily apparent that the dual lever control mechanism 10 of the present invention provides improved actuation of a pair of control devices 12 and 14 into either their first modes of operation or their second modes of operation for effecting simultaneous coordinated movement thereof, or for selectively moving these control devices respectively into their diametrically opposite modes of operation for effecting simultaneously opposite coordinated movement thereof. Such action is particularly adapted for manipulating a pair of hydraulic jacks 20 and 34 for respectively tipping or tilting a bulldozer blade relative to a vehicle on which it is mounted. It is further apparent that movement of either of the control levers 16 or 18 will not cause movement of the other one, and because of the decoupling action resulting from the predetermined clearance 64 and the further decoupling action due to the arms 66 and 68 respectively within the profiled apertures 78 and 94, an operator will only need to overcome the force independently resulting from the centering apparatus 90 or 100.

While the invention has been described and shown with particular reference to a preferred embodiment, it will be apparent that variations are possible which would fall within the spirit of the present invention, which is not intended to be limited except by the scope of the following claims.

What is claimed is:

1. A dual lever control mechanism, including a first control lever and a second control lever for actuating a pair of control devices individually having first and second modes of operation, comprising:

a stationary support having the control levers pivotally connected thereto;

first means including an intermediate actuating element pivotally connected to said first control lever and cooperatively engaged with said second control lever for selectively moving both of the control devices into either their first modes of operation of their second modes of operation and effecting simultaneous coordinated movement of the control devices in the same travel direction in response to movement of the first control lever; and second means cooperatively couple with said first means of selectively moving both of the control devices respectively into either their first and second modes of operation or their second and first modes of operation and effecting simultaneously coordinated movement of the control devices in opposite travel directions in response to movement of the second control lever, said second means having defined therein profiled aperture means for selectively coupled engagement with said actuating element, said mechanism being of a construction such that selective movement of said first control lever and said actuating element is free from transmission to said second control lever and selective movement of said second control lever is transmitted to said actuating element free from transmission to said first control lever and movement of one of said control levers is independent of movement of the other one of said control levers.

2. The control mechanism of claim 1 wherein said second control lever has a central neutral position and operative positions on the opposite sides thereof, and said mechanism includes centering apparatus means connected to said support for biasing said second control lever toward said neutral position.

3. The control mechanism of claim 2 wherein said first control lever has a central neutral position and operative positions on the opposite sides thereof, and said mechanism includes another centering apparatus means connected to said support for biasing said first means and said first control lever toward said neutral condition.

4. The control mechanism of claim 1 including a source of fluid under pressure, and wherein said control devices each includes a hydraulic jack and control valve means communicating therewith for directing fluid from the source of the jack and extending and retracting the jack, said first and second means being of a construction to operate said control valve means.

5. The control mechanism of claim 4 wherein one of said control valve means includes an electrically operated valve.

6. The control mechanism of claim 5 including a source of electricity and wherein said first means includes a pair of switches connected to said source of electricity and being responsive to movement of said first control lever for operating said electrically operated valve.

7. The control mechanism of claim 6 wherein said second means includes a pair of switches connected to said source of electricity and being responsive to movement of said second control lever for operating said electrically operated valve.

* * * * *